US005155014A

United States Patent [19]

De Prijcker et al.

[11] Patent Number: 5,155,014

[45] Date of Patent: Oct. 13, 1992

[54] METHOD OF DEVELOPING DIRECT POSITIVE SILVER HALIDE MATERIAL

[75] Inventors: Jozef P. De Prijcker, Hamme; Fernand I. Ketels, Kontich; Jean-Marie O. Dewanckele, Drongen; Piet Kok, Gent, all of Belgium

[73] Assignee: AGFA-Gevaert, N.V., Mortsel, Belgium

[21] Appl. No.: 746,800

[22] Filed: Aug. 14, 1991

Related U.S. Application Data

[63] Continuation of Ser. No. 565,352, Aug. 10, 1990, abandoned.

[30] Foreign Application Priority Data

Sep. 4, 1989 [BE] Belgium ..... 89202231

[51] Int. Cl.[5] ..... G03C 5/26

[52] U.S. Cl. ..... 430/406; 430/410; 430/415; 430/438; 430/448; 430/464; 430/481; 430/484; 430/485; 430/486; 430/490

[58] Field of Search ..... 430/378, 406, 409, 410, 430/434, 438, 464, 468, 469, 481, 484, 487, 490, 547, 589

[56] References Cited

U.S. PATENT DOCUMENTS

| | | | |
|---|---|---|---|
| 1,925,557 | 9/1933 | Dundon | 430/490 |
| 2,915,394 | 12/1959 | Krizka | 430/490 |
| 4,416,969 | 11/1983 | Magee et al. | 430/410 |
| 4,444,871 | 4/1984 | Miyaoka et al. | 430/409 |
| 4,789,627 | 12/1988 | Inoue et al. | 430/410 |
| 4,877,723 | 10/1989 | Hirano et al. | 430/410 |

*Primary Examiner*—Hoa Van Le
*Attorney, Agent, or Firm*—Breiner & Breiner

[57] ABSTRACT

Method for the production of direct-positive images by image-wise exposing a light-sensitive silver halide material comprising a support and an internal latent image-type silver halide emulsion layer and developing said exposed material in the presence of at least one development nucleator and density-increasing amounts of a compound chosen from the class consisting of formic acid, oxalic acid, glyoxylic acid, or salts of these and/or of a compound chosen from the class consisting of polyethylene glycols, with a hydroquinone-type developing solution having a pH not higher than 12.0 and comprising less than 25 g per liter of a hydroquinone and 5 to 100 g per liter of at least one alkanolamine.

10 Claims, No Drawings

METHOD OF DEVELOPING DIRECT POSITIVE SILVER HALIDE MATERIAL

This is a continuation of co-pending application Ser. No. 07/565,352 filed on Aug. 10, 1990, now abandoned.

BACKGROUND OF THE INVENTION

1. Field of the Invention

The present invention relates to a method of developing in the presence of a development nucleator photographic light-sensitive silver halide materials for the formation of direct-positive images having a satisfactory maximum density with a hydroquinone-type developing solution having a pH-value not higher than 12.0.

In silver halide photography a photographic method, according to which a positive image is made without the use of a negative image or an intermediary process producing a negative image, is called a direct-positive method. A photographic light-sensitive material and a photographic emulsion for use according to such photographic method are called direct-positive material and direct-positive emulsion respectively.

A variety of direct-positive photographic methods are known. The most useful methods are the method, which comprises exposing prefogged silver halide grains to light in the presence of a desensitizing agent and developing them, and the method, which comprises subjecting a silver halide emulsion containing silver halide grains that have light-sensitive specks mainly inside the grains to an image-wise exposure and developing the exposed emulsion in the presence of a development nucleator. The present invention relates to the latter method. A silver halide emulsion comprising light-sensitive specks mainly inside the grains and which forms latent images mainly inside the grains is referred to as internal latent image-type silver halide emulsion, and thus is distinguished from silver halide grains that form latent images mainly at the surface of the grains.

It is known to develop a latent image that has been formed mainly inside the grains by means of a so-called internal developer, but the method, material, and emulsions used in accordance with the present invention are not concerned with that type of development, but rather with the type of development using a so-called surface developer.

2. Description of the Prior Art

Methods for making a direct-positive image by development of an exposed internal latent image type-silver halide emulsion in the presence of a development nucleator by means of a surface developer, and photographic emulsions and photographic light-sensitive materials used in such methods have been disclosed in i.a. GB-A 1,011,062, 1,151,363, 1,195,837, in JA Patent Publication No. 29,405/68, and in U.S. Pat. Nos. 2,456,953, 2,497,875, 2,497,876, 2,588,982, 2,592,250, 2,675,318, 3,227,552, 3,761,276, 4,540,655.

In the internal latent image-type method for making a direct-positive image, the development nucleator may be incorporated into a developing solution, but it is usually incorporated into the photographic emulsion layer or in another layer of the photographic light-sensitive material, the development nucleator being adsorbed at the surface of the silver halide grains. Development nucleators that can be used in the above-described method for making a direct-positive image include hydrazine and derivatives thereof as described in i.a. "Zeitschrift für Wissenschaftliche Photographie" by Arens, vol. 48, (1953) p. 48, DD-A 5024, DE-A 3,021,423, and in U.S. Pat. No. 2,563,785, 2,588,982, 3,227,552, 4,245,037, 4,374,923, 4,540,655, in Research Disclosure 23,510, p. 346–348 and the documents referred to therein.

The fogging action of development nucleators in internal latent-type silver halide emulsions is triggered only when the pH of the developing solution used is sufficiently high i.e. at least 11. To reach satisfactory results in particular with respect to Dmax it is customary to increase the pH to values as high as 12 to 13. However, an increase of the pH of the developing solution to such high values leads to an increased susceptibility of the solution to aerial oxidation. The oxidation products give rise to substantial changes in the photographic characteristics especially a reduced Dmax.

SUMMARY OF THE INVENTION

It is therefore an object of the present invention to provide a method of developing in the presence of a development nucleator photographic light-sensitive silver halide materials for the formation of direct-positive images having a satisfactory maximum density with a hydroquinone-type developing solution having a pH-value not higher than 12.0.

Other objects of the present invention will become apparent from the description hereinafter.

It has been found now that the above objects are accomplished by a method for the production of direct-positive images comprising:

- image-wise exposing a photographic light-sensitive silver halide material comprising a support and at least one internal latent image-type silver halide emulsion layer, and
- developing said exposed silver halide material in the presence of
  - at least one development nucleator e.g. of the class of the hydrazines and derivatives thereof and
  - density-increasing amounts of a compound chosen from the class consisting of formic acid, oxalic acid, glyoxylic acid, or salts of these and/or of a compound chosen from the class consisting of polyethylene glycols,
  - with a hydroquinone-type developing solution having a pH not higher than 12.0 and comprising:
  - less than 25 g per liter of a hydroquinone and
  - 5 to 100 g per liter of at least one alkanolamine, preferably 10 to 60 g per liter of at least one alkanolamine.

DETAILED DESCRIPTION OF THE INVENTION

It has been established unexpectedly that by developing—in the presence of development nucleator—exposed photographic light-sensitive silver halide materials comprising an internal latent image, direct-positive images having a satisfactory maximum density can be obtained, even when for said development use is made of a hydroquinone surface-type developer that has a pH not higher than 12.0 and comprises less than 25 g per liter of a hydroquinone, if only said development is carried out in the presence of density-increasing amounts of a compound of the class of formic acid, oxalic acid, glyoxylic acid, or salts of these and/or of a compound chosen from the class of polyethylene glycols and if at least one alkanolamine is added to said developer in amounts of 5 to 100 g per liter.

In the description hereinafter details will be given about i.a. the development nucleators, the alkanolamines, and the density-increasing agents that can be used in the method of the present invention and in the materials used therefor.

The development nucleators for use in accordance with the present invention may be any of the compounds known for that purpose. Suitable development nucleators are e.g.: sulphur compounds e.g. thiourea dioxide, phosphonium salts e.g. tetra(hydroxymethyl)-phosphonium chloride, hydroxylamine, bis-(p-aminoethyl)-sulphide and water-soluble salts thereof, reductic acid and derivatives thereof e.g. 4,4,5,5-tetramethylreductic acid, kojic acid, ascorbic acid, 2-hydroxy-1,3-cyclohexanedione, 2-acetoxy-1,2-di(2-pyridyl)-ethanone, 2-hydroxy-1,2-di(2-pyridyl)-ethanone, reactive N-substituted cycloammonium quaternary salts, and hydrazine-type compounds e.g. 1-diphenyl-hydrazine hydrochloride and 1,2-dipyridyl-hydrazine hydrochloride.

Suitable development nucleators of the class of reactive N-substituted cycloammonium quaternary salts correspond to the following general formula I:

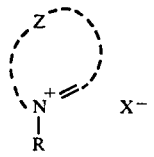

(I)

wherein:

R represents hydrogen, an alkyl group, a substituted alkyl group, an aralkyl group, a substituted aralkyl group, an alkaryl group, a substituted alkaryl group, an aryl group, or a substituted aryl group, Z represents the atoms needed to complete a heterocyclic nucleus or a substituted heterocyclic nucleus, which heterocyclic nucleus may carry a fused-on heterocyclic or carbocyclic ring, and X is an anion.

A representative development nucleator corresponding to general formula I has the following structural formula:

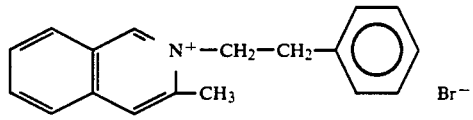

Other suitable development nucleators for use in accordance with the present invention are the hydrazine-type compounds corresponding to the following general formula II:

$$R^1—NH—NH—CO—R^2 \quad (II)$$

wherein: each of $R^1$ and $R^2$ (same or different) represent hydrogen, an alkyl group, a substituted alkyl group, an aryl group, or a substituted aryl group.

Preferred development nucleators for use in accordance with the present invention are phenyl hydrazides e.g. 1-formyl-2-phenyl-hydrazine, 1-p-acetamidophenyl-2-acetyl-hydrazine, and 1-[2-(2,4-di-tert-pentylphenoxy)-propionamidophenyl]-2-formyl-hydrazine.

Another class of suitable hydrazine-type development nucleators are hydrazines comprising a heterocyclic nitrogen-containing nucleus or a substituted heterocyclic nitrogen-containing nucleus e.g. a thiohydantoin nucleus and a mercaptotetrazolyl nucleus. Examples of such compounds are the following compounds III and IV:

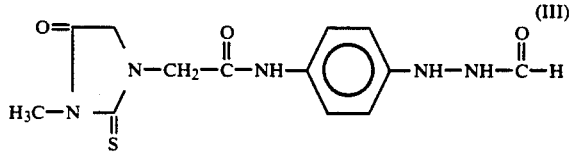

(III)

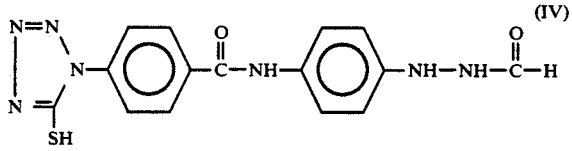

(IV)

A preferred class of hydrazine-type development nucleators for use in accordance with the present invention, which comprise a heterocyclic nitrogen-containing nucleus are the hydrazines carrying a pyrazolidin-3-one-1-yl-phenyl group or a substituted pyrazolidin-3-one-1-yl-phenyl group. Examples of such preferred development nucleators are the compounds according to the following structural formulae V to XIII:

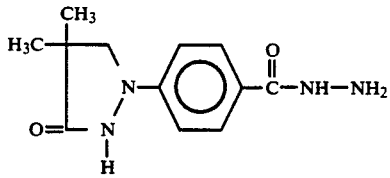

(V)

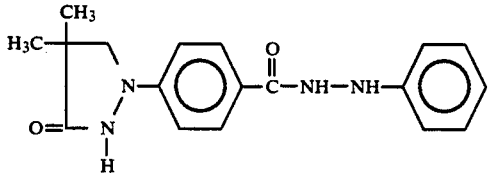

(VI)

-continued

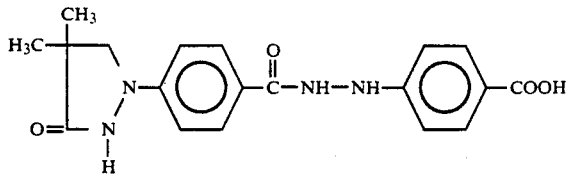
(VII)

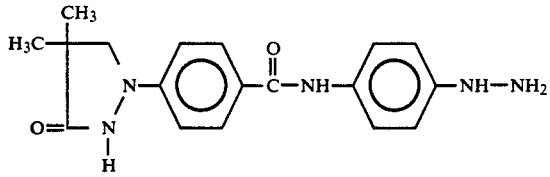
(VIII)

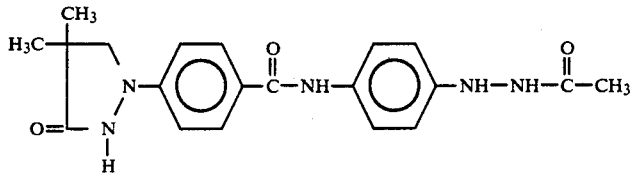
(IX)

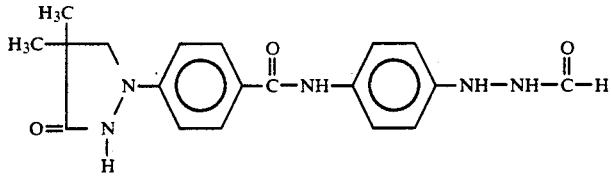
(X)

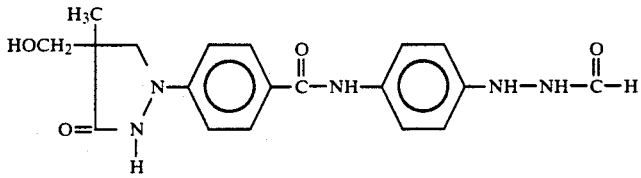
(XI)

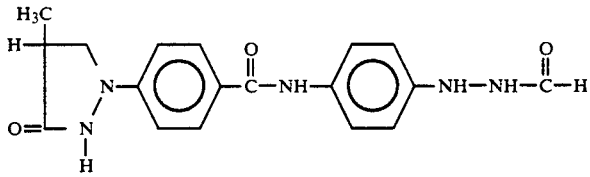
(XII)

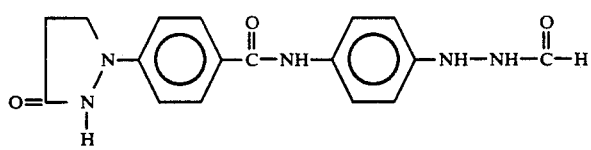
(XIII)

An interesting class of development nucleators corresponding to general formula II are the phenyl hydrazides containing water-solubilizing polyhydroxy moieties. Representatives of this class correspond to the following general formula XIV:

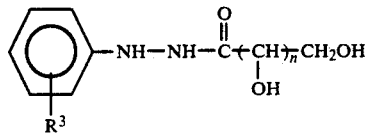
(XIV)

wherein:

n is a positive integer ranging from 1 to 10 and $R^3$ is hydrogen, an alkyl group, a substituted alkyl group, an aryl group, a substituted aryl group, a heterocyclic group, or a substituted heterocyclic group.

A suitable example of a heterocyclic group represented by $R^3$ in general formula XIV is a pyrazolidin-3-one-1-yl group, which may be substituted.

Examples of development nucleators corresponding to general formula XIV are the compounds, in which n is 4 or 5 and $R^3$ stands for hydrogen.

Mixtures of at least 2 of the above-mentioned development nucleators can be used advantageously.

Nucleating amounts of the development nucleators are present during development of the photographic element and can be incorporated for that purpose e.g.

into the light-sensitive silver halide emulsion layer or into a hydrophilic colloid layer in water-permeable relationship therewith. Alternatively, they can also be added to the developing bath or to a separate bath.

When used in the silver halide emulsion layer the development nucleators are present in a concentration of $10^{-4}$ mol to $10^{-1}$ mol per mol of silver halide.

Prior to the coating of the composition that will form the photographic layer comprising at least one development nucleator, the development nucleator(s) can be dissolved in an organic solvent and added to said composition. For instance, $1.3\times10^{-3}$ mol of the development nucleator is added in the form of a 3.5% solution in N-methyl-pyrrolidone per mol of silver.

According to a preferred embodiment the development nucleator(s) are added in dispersed form to the hydrophilic colloid composition that will form said emulsion layer or said hydrophilic colloid layer. When these hydrazines are present in dispersed form in a hydrophilic colloid layer, preferably in the internal latent image-type silver halide emulsion layer, the direct-positive images obtained upon development have a very fine grain.

The development nucleator(s) can be incorporated into the hydrophilic colloid composition that will form said emulsion layer or said hydrophilic colloid layer by dissolving them first in at least one water-immiscible, oil-type solvent or oil-former, adding the resulting solution to an aqueous phase containing a hydrophilic colloid preferably gelatin and a dispersing agent, passing the mixture through a homogenizing apparatus so that a dispersion of the oily solution in an aqueous medium is formed, mixing the dispersion with a hydrophilic colloid composition e.g. a gelatin silver halide emulsion, and coating the resulting composition in the usual manner to produce a system in which particles of development nucleator(s), surrounded by an oily membrane, are distributed throughout the gel matrix. The dissolution of the development nucleator(s) in the oil-former may be facilitated by the use of an auxiliary low-boiling water-immiscible solvent, which is removed afterwards by evaporation.

The development nucleator(s) can be dispersed in hydrophilic colloid compositions with the aid of at least one known oil-former e.g. an alkyl ester of phthalic acid. The oil-formers can be used in widely varying concentrations e.g. in amounts ranging from about 0.1 to about 10 parts by weight and preferably from 0.5 to 2 parts by weight relative to the amount of the development nucleator(s) dispersed therewith.

It may be useful to combine the oil-former with at least one auxiliary solvent that is insoluble or almost insoluble in water and has a boiling point of at most 150° C., such as a lower alkyl acetate e.g. ethyl acetate.

According to a preferred embodiment of the present invention the development nucleator(s) are incorporated into the hydrophilic colloid composition that will form said silver halide emulsion layer or said hydrophilic colloid layer by mixing the development nucleator(s) in the absence of an oil-former and a solvent with an aqueous hydrophilic colloid solution, preferably an aqueous gelatin solution, passing the resulting mixture through a homogenizing apparatus, adding the dispersion obtained to said hydrophilic colloid composition that will form said emulsion layer or said hydrophilic colloid layer, and coating said hydrophilic colloid composition on a support.

The homogenizing apparatus can be any of the devices currently used for making dispersions e.g. an ultrasonic power generator, a mill such as a ball mill, a sand mill, and a colloid mill.

In the direct-positive photographic light-sensitive material according to the present invention, it is preferred that the development nucleator(s) be incorporated into an internal latent image-type silver halide emulsion layer. However, the development nucleator(s) can also be incorporated into a hydrophilic colloid layer that stands in water-permeable relationship with an internal latent image-type silver halide emulsion layer. Such a hydrophilic colloid layer can be any layer that makes part of the direct-positive photographic light-sensitive material according to the present invention. It can thus be i.a. a light-sensitive layer, an intermediate layer, a filter layer, a protective layer, an antihalation layer, an antistress layer, a subbing layer, or any other layer. In other words, any layer will do provided the development nucleator(s) is not prevented from diffusing to the internal latent image-type silver halide emulsion layer.

The development nucleator(s) used according to the present invention preferably is(are) incorporated into the layer(s) in an amount that yields satisfactory maximum density values of e.g. at least 1.50 when the internal latent image-type emulsion is developed with a surface-developing solution. The amount may vary within wide limits and depends upon the nature of the silver halide emulsion, the chemical structure of the development nucleator(s), and on the developing conditions. Nevertheless, an amount of from about 0.1 to about 15 g per mol of silver halide in the internal latent image-type silver halide emulsion is generally effective, more preferably an amount of from about 0.6 to about 9 g per mol of silver halide. When the development nucleator(s) is(are) incorporated into a hydrophilic colloid layer that stands in water-permeable relationship with the internal latent image-type silver halide emulsion layer, it is adequate to incorporate the development nucleator(s) in the above amounts while taking into account the amount of silver contained in the associated internal latent image-type emulsion layer.

An internal latent image-type silver halide emulsion is an emulsion, the maximum density of which obtained when developing it with an "internal type" developing solution exceeds the maximum density that is achievable when developing it with a "surface-type" developing solution. The internal latent image-type emulsions that are suited for use in accordance with the present invention yield a maximum density that, when these emulsions have been coated on a transparent support and are exposed to light for a fixed time of from 1/100 to 1 s and then developed for 3 min at 20° C. with the internal-type Developing Solution A as described hereinafter, is higher by at least 5 times than the maximum density obtained when the silver halide emulsion exposed as described above is developed for 4 min at 20° C. with the surface-type Developing Solution B as described hereinafter.

| Internal-type Developing Solution A | |
|---|---|
| hydroquinone | 15 g |
| monomethyl-p-aminophenol sulphate | 15 g |
| anhydrous sodium sulphite | 50 g |
| potassium bromide | 10 g |
| sodium hydroxide | 25 g |
| crystalline sodium thiosulphate | 20 g |

-continued

| | |
|---|---|
| Water to make | 1 l |
| Surface-type Developing Solution B | |
| p-hydroxyphenylglycine | 10 g |
| crystalline sodium carbonate | 100 g |
| water to make | 1 l |

Internal latent image-type silver halide emulsions that can be used in accordance with the present invention have been described in e.g. U.S. Pat. Nos. 2,592,250, 3,206,313, 3,271,157, 3,447,927, 3,511,662, 3,737,313, 3,761,276, GB-A 1,027,146, and JA Patent Publication No. 34,213/77. However, the silver halide emulsions used in the present invention are not limited to the silver halide emulsions described in these documents.

Internal latent image-type silver halide emulsions that are suited for use in the method of the present invention generally are emulsions that have not been prefogged or only slightly so and have not been ripened chemically or only slightly so.

The photographic emulsions can be prepared according to different methods as described e.g. by P. Glafkides in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion", The Focal Press, London (1966).

The photographic silver halide emulsions used in the method of the present invention can be prepared by mixing the halide and silver solutions in partially or fully controlled conditions of temperature, concentrations, sequence of addition, and rates of addition. The silver halide can be precipitated according to the single-jet method, the double-jet method, or the conversion method. The conversion method has proved to be particularly suitable. According to this method a more soluble silver halide is converted into a less soluble silver halide. For instance a silver chloride emulsion is converted in the presence of water-soluble bromide and possibly iodide, the amounts of which are selected with regard to the finally required composition, into a silver chlorobromoiodide or a silver bromoiodide emulsion. This conversion is preferably carried out very slowly in several consecutive steps i.e. by converting a part of the more soluble silver halide at a time. Another technique by which emulsions with an increased internal latent image sensitivity can be prepared has been described in GB-A 1,011,062.

The silver halide particles of the photographic emulsions used in the method of the present invention may have a regular crystalline form such as a cubic or octahedral form or they may have a transition form. They may also have an irregular crystalline form such as a spherical form or a tabular form, or may otherwise have a composite crystal form comprising a mixture of said regular and irregular crystalline forms.

The silver halide grains may have a multilayered grain structure. According to a simple embodiment the grains may comprise a core and a shell, which may have different halide compositions and/or may have undergone different modifications such as the addition of dopes. Besides having a differently composed core and shell the silver halide grains may also comprise different phases inbetween.

Two or more types of silver halide emulsions that have been prepared differently can be mixed for forming a photographic emulsion for use in the method of the present invention.

The average size of the silver halide grains may range from 0.1 to 2.0 μm, preferably from 0.3 to 0.8 μm.

The size distribution of the silver halide particles of the photographic emulsions used in the method of the present invention can be homodisperse or heterodisperse. A homodisperse size distribution is obtained when 95% of the grains have a size that does not deviate more than 30% from the average grain size.

In addition to silver halide the emulsions may also comprise organic silver salts such as e.g. silver benzotriazolate and silver behenate.

The silver halide crystals can be doped with $Rh^{3+}$, $Ir^{4+}$, $Cd^{2+}$, $Zn^{2+}$, $Pb^{2+}$.

The photographic emulsions may comprise substances that will provide iodide and/or bromide ions (in excess of any such ions provided by the light-sensitive emulsion itself) during the development of the exposed emulsions. Such compounds and the method using them have been described in GB-A 1,195,837.

The emulsion can be left unwashed or it can be desalted in the usual ways e.g. by dialysis, by flocculation and re-dispersing, or by ultrafiltration.

Commonly, the light-sensitive silver halide emulsion used in the method of the present invention has not been sensitized chemically. However, it may have been chemically sensitized or prefogged to a certain degree. Chemical sensitization can be performed as described i.a. in the above-mentioned "Chimie et Physique Photographique" by P. Glafkides, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripeners or by means of reductors e.g. tin compounds as described in GB-A 789,823, amines, hydrazine derivatives, formamidine-sulphinic acids, and silane compounds. Chemical sensitization can also be performed with small amounts of Ir, Rh, Ru, Pb, Cd, Hg, Tl, Pd, Pt, or Au. One of these chemical sensitization methods or a combination thereof can be used.

The spectral photosensitivity of the silver halide can be adjusted by proper sensitization to any desired spectral range comprised between 300 and 900 nm e.g. to blue light of relatively long wavelengths, to green light, to red light, to infrared light, by means of the usual mono- or polymethine dyes such as acidic or basic cyanines, hemicyanines, oxonols, hemioxonols, styryl dyes or others, also tri- or polynuclear methine dyes e.g. rhodacyanines or neocyanines. Such spectral sensitizers have been described by e.g. F. M. Hamer in "The Cyanine Dyes and Related Compounds" (1964) Interscience Publishers, John Wiley & Sons, New York. The spectral photosensitivity of the silver halide can also be adjusted for exposure by laser light e.g. helium-neon laser light, argon laser light, and solid state laser light. Dyes that can be used for adjusting the photosensitivity to laser light have been described in i.a. JA-A 62284344, 62284345, 62141561, 62103649, 62139555, 62105147, 62105148, 62075638, 62062353, 62062354, 62062355, 62157027, 62157028, 62113148, 61203446, 62003250, 60061752, 55070834, 51115821, 51115822, 51106422, 51106423, 51106425; DE-A 3,826,700; U.S. Pat. Nos. 4,501,811, 4,725,532, 4,784,933; GB-A 1,467,638; and EP-A 100,654 and in documents cited therein. The silver halide can also be sensitized with dyes providing a spectral sensitivity mainly in the range of 400 to 540 nm and not extending the sensitivity substantially beyond 540 nm so that the resulting photosensitive material can be handled in safe-light conditions prior to the image-wise exposure. Suitable dyes that can be used for that purpose have been described in e.g. U.S. Pat. No. 4,686,170.

Other useful sensitizing dyes that can be employed in accordance with the present invention have been described in e.g. U.S. Pat. Nos. 2,503,776, 2,526,632, 3,522,052, 3,556,800, 3,567,458, 3,615,613, 3,615,632, 3,615,635, 3,615,638, 3,615,643, 3,617,293, 3,619,197, 3,625,698, 3,628,964, 3,632,349, 3,666,480, 3,667,960, 3,672,897, 3,677,765, 3,679,428, 3,703,377, 3,705,809, 3,713,828, 3,713,828, 3,745,014, 3,769,025, 3,769,026, 3,770,440, 3,770,449, GB-A 1,404,511, and BE-A 691,807.

The sensitizing dyes employed in the present invention are used in a concentration almost equivalent to that used in ordinary negative silver halide emulsions. In particular, it is advantageous that the sensitizing dyes be employed in a dye concentration to a degree that does not substantially cause desensitization in the region of intrinsic sensitivity of the silver halide emulsion. It is preferred that the sensitizing dyes be employed in a concentration of from about $1.0\times10^{-5}$ to about $5\times10^{-4}$ mol per mol of silver halide, and particularly in a concentration of from about $4\times10^{-5}$ to $2\times10^{-4}$ mol per mol of silver halide.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/formaldehyde condensation products as described e.g. in U.S. Pat. No. 3,743,510, cadmium salts, and azaindene compounds.

The density-increasing compound used in the method of the present invention may be incorporated into the photographic light-sensitive silver halide material, preferably into an internal latent image-type silver halide emulsion layer, but the density-increasing compound may be incorporated also into a hydrophilic colloid layer that stands in water-permeable relationship with the internal latent image-type silver halide emulsion layer. As mentioned before such a hydrophilic colloid layer can be any layer that makes part of the direct-positive photographic light-sensitive material according to the present invention e.g. a light-sensitive layer, an intermediate layer, a filter layer, a protective layer, an antihalation layer, an antistress layer, a subbing layer, or any other layer. When incorporated into the photographic material the density-increasing compound is present in amounts of from 4 to 600 mg/m2, preferably from 40 to 300 mg/m2. When the density-increasing compound is incorporated into a hydrophilic colloid layer it is present therein in the form of a salt e.g. sodium or potassium formiate or oxalate.

It is also possible to incorporate the density-increasing compound into a hydrophilic colloid layer that does not stand in direct water-permeable relationship with the internal latent image-type silver halide emulsion layer e.g. because an impermeable support constitutes a barrier between said emulsion layer and said hydrophilic colloid layer. In that case the density-increasing compound can during treatment of the exposed material with a developing solution or a prebath diffuse via said developing solution or said prebath towards the silver halide emulsion layer and have its effect there. Such layers are e.g. layers that have been coated on the rear side of the support and which may serve different purposes. Examples of such layers are e.g. a back layer, an anti-curling layer, and an antistatic layer.

The density-increasing compound may also be added to the developing solution in amounts of from 0.2 to 30 g/l, preferably from 1 to 10 g/l. The density-increasing compound may also be added to another processing solution e.g. a prebath. When the density-increasing compound is added to the developing solution or to a prebath it is present therein in acid form or in the form of a salt.

Preference is given to oxalic acid for use as density-increasing compound according to the present invention, because it has the highest density-increasing effect and can thus be used in lower concentrations.

In the processing method of the present invention any of the known methods can be employed. Specifically, the processing method of the present invention basically includes a development step and a fixing step. A stopping step and a rinsing step can be included as well, if desired. The processing temperature is usually selected within the range of from 18° C. to 50° C. However, temperatures lower than 18° C. and temperatures higher than 50° C. can be employed, if desired. The processing time may vary within broad ranges provided the mechanical strength of the materials to be processed is not adversely influenced and no decomposition takes place.

The hydroquinone-type developing solution used for developing an exposed photographic material in accordance with the present invention comprises at least one alkanolamine, which may be chosen from primary, secondary, and tertiary alkanolamines. Suitable alkanolamines are i.a. N,N,N-triethanolamine, 2-amino-2-hydroxymethyl-propan-1,3-diol, N-methyl-diethanolamine, N-ethyl-diethanolamine, diisopropanolamine, N,N-diethanolamine, 3,3'-amino-dipropanol, 2-amino-2-methyl-propan-1,3-diol, N-propyl-diethanolamine, N-butyl-diethanolamine, N,N-dimethyl-ethanolamine, N,N-diethyl-ethanolamine, N,N-diethyl-isopropanolamine, 1-amino-propan-2-ol, N-ethanolamine, N-methyl-ethanolamine, N-ethyl-ethanolamine, N-ethyl-propanolamine, 3-amino-propanol, 3-dimethylamino-propanol, 4-amino-butanol, and 5-amino-pentan-1-ol.

The alkanolamine or a mixture of alkanolamines are present in the developing solution in amounts of from 1 to 100 g/l, preferably from 10 to 60 g/l.

In the developing solution used in the processing method of the present invention, a hydroquinone alone or a combination of a hydroquinone with a secondary developing agent of the class of 1-phenyl-3-pyrazolidinone compounds and p-N-methyl-aminophenol can be used as developing agent. Specific examples of hydroquinones include hydroquinone, methylhydroquinone, t-butyl-hydroquinone, chloro-hydroquinone, and bromohydroquinone. The amount of the hydroquinone used is less than 25 g per liter.

Particularly useful 1-phenyl-3-pyrazolidinone developing agents that can be used in combination with a hydroquinone are 1-phenyl-3-pyrazolidinone, 1-phenyl-4-methyl-3-pyrazolidinone, 1-phenyl-4-ethyl-5-methyl-3-pyrazolidinone, and 1-phenyl-4,4-dimethyl-3-pyrazolidinone.

N-methyl-p-aminophenol and 2,4-diaminophenol can be used in combination with a hydroquinone as a developing agent.

When the secondary developing agent used in the processing method of the present invention is one of the class of the 1-phenyl-3-pyrazolidinone compounds it is preferably present in an amount of 2 to 20 g per liter. When the secondary developing agent is p-N-methylaminophenol it is preferably present in an amount of 10 to 40 g per liter.

As mentioned hereinbefore the pH of the developing solution used in the method of the present invention must not be higher than 12.0. In most cases the pH-value is at least 10 and preferably it is in the range of 11.0 to 11.8.

The developing solution comprises a preservative such as a sulphite e.g. sodium sulphite in an amount ranging from 45 g to 160 g per liter.

The developing solution comprises such alkali-providing substances like hydroxides of sodium and potassium, alkali metal salts of phosphoric acid and/or silicic acid e.g. trisodium phosphate, orthosilicates, metasilicates, hydrodisilicates of sodium or potassium, and sodium carbonate. The alkali-providing substances can be substituted in part or wholly by alkanolamines.

The developing solution may comprise a buffering agent such as a carbonate e.g. sodium carbonate, potassium carbonate, trisodium phosphate, and sodium metaborate.

For the purpose of decreasing the formation of fog (Dmin) the developing solution may further contain an inorganic anti-fogging agent such as a bromide, e.g. potassium bromide and/or an organic anti-fogging agent such as a benzimidazole e.g., 5-nitro-benzimidazole, a benzotriazole like benzotriazole itself and 5-methyl-benzotriazole.

The developing solution may contain other ingredients such as i.a. toning agents, development accelerators, oxidation preservatives, surface-active agents, defoaming agents, water-softeners, anti-sludge agents, hardeners including latent hardeners, and viscosity-adjusting agents.

Regeneration of the developing solution according to known methods is, of course, possible.

The development may be stopped—though this is often not necessary—with an aqueous solution having a low pH. An aqueous solution having a pH not higher than 3.5 comprising e.g. acetic acid and sulphuric acid, and containing a buffering agent is preferred.

Buffered stop bath compositions comprising a mixture of sodium dihydrogen orthophosphate and disodium hydrogen orthophosphate are preferred.

Conventional fixing solutions may be used. Examples of useful fixing agents include organic sulphur compounds known as fixing agents, as well as a thiosulphate, a thiocyanate, etc. The fixing solution may contain a water-soluble aluminium salt as a hardening agent.

The stopping solution may be an aqueous solution having a low pH. An aqueous solution having a pH not higher than 3.5 comprising e.g. acetic acid and sulphuric acid, and containing a buffering agent is preferred.

The photographic light-sensitive silver halide material for use in the method of the present invention comprises an internal latent image-type silver halide emulsion layer, which preferably is a gelatin silver halide emulsion layer. However, instead of gelatin or in admixture with gelatin a variety of other hydrophilic colloids can be used as the binder for the silver halide.

Other suitable hydrophilic colloids that can be used as the binder for the silver halide are synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Other synthetic substitutes for gelatin are latices such as a latex of poly(ethyl acrylate). Natural substitutes for gelatin are e.g. other proteins such as zein, albumin and casein, cellulose derivatives, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates. The presence of such other binders often has a favourable photographic effect on the formation of the direct-positive image. For instance, the addition of polyvinyl pyrrolidone and of said latex of poly(ethyl acrylate) often increases the maximum density of the direct-positive image.

Suitable additives for improving the dimensional stability of the photographic element can also be incorporated together with the hydrophilic colloid. Suitable examples of this type of compounds include i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth-)acrylates, and styrene sulphonic acids.

The binder should dispose of an acceptably high number of functional groups, which by reaction with an appropriate hardening agent can provide a sufficiently resistant layer. Such functional groups are especially the amino groups, but also carboxylic groups, hydroxy groups, and active methylene groups.

The gelatin can be lime-treated or acid-treated gelatin. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No 16, page 30 (1966).

Various compounds can be added to the photographic emulsion to prevent the reduction in sensitivity or fog formation during preparation, storage, or processing of the photographic light-sensitive material. A great many compounds are known for these purposes, and they include homopolar or salt-like compounds of mercury with aromatic or heterocyclic rings such as mercaptotriazoles, simple mercury salts, sulphonium mercury double salts and other mercury compounds. Other suitable stabilizers are azaindenes, preferably tetra- or penta-azaindenes, especially those substituted with hydroxy or amino groups e.g. 4-hydroxy-6-methyl-1,3,3a,7-tetra-azaindene. Compounds of this kind have been described by Birr in Z. Wiss. Photogr. Photophys. Photochem. 47, 2–27 (1952). Other suitable stabilizers are i.a. heterocyclic mercapto compounds e.g. 1-phenyl-5-mercaptotetrazole, 3-methyl-benzothiazole, quaternary benzothiazole derivatives, benzotriazole. Specific examples of stabilizers have been mentioned by K. Mees in The Theory of the Photographic Process, 3rd ed. 1966 by reference to the papers that first reported such compounds, and in addition, have been described in i.a. U.S. Pat. Nos. 1,758,576, 2,110,178, 2,131,038, 2,173,628, 2,304,962, 2,324,123, 2,394,198, 2,444,605, 2,444,606, 2,444,607, 2,444,608, 2,476,536, 2,566,245, 2,694,716, 2,697,040, 2,697,099, 2,708,162, 2,728,663, 2,728,664, 2,728,665, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, and 3,622,339, GB-A 893,428, 403,789, 1,173,609, and 1,200,188.

The silver halide emulsions may comprise other ingredients e.g. developement accelerators, wetting agents, and hardeners. The binder of the silver halide emulsion layer and/or of other hydrophilic colloid layers can, especially when the binder used is gelatin, be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydatoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts and the phosphorus compounds described in EP Application No 89201865.6.

Compounds that release iodine ions e.g. potassium iodide can be incorporated into the photographic silver halide emulsion. Additionally, the developing solution used in the method of the present invention may also contain iodine ions.

The photographic light-sensitive material used in the method of the present invention may contain a water-soluble dye in a hydrophilic colloid layer as a filter dye or for other various purposes such as for the prevention of irradiation or anti-halation. Such dyes include oxonol dyes, hemioxonol dyes, styryl dyes, merocyanine dyes, cyanine dyes, and azo dyes. Of these, oxonol dyes, hemioxonol dyes, and merocyanine dyes are useful.

When a hydrophilic colloid layer of the photographic light-sensitive material used in the method of the present invention contains a dye or an UV-absorbing agent, these compounds may be mordanted by means of a cationic polymer e.g. polymers described in GB-A 1,468,460 and 685,475, U.S. Pat. Nos. 2,675,316, 2,839,401, 2,882,156, 3,048,487, 3,184,309, 3,445,231, and 3,986,875, DE-A 1,914,362.

The photographic light-sensitive material for use in the method of the present invention may comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g. higher contrast, sensitization, and development acceleration.

Development acceleration can be accomplished with the aid of various compounds, preferably polyalkylene derivatives having a molecular weight of at least 400 such as those described in e.g. U.S. Pat. Nos. 3,038,805, 4,038,075, and 4,292,400.

The photographic light-sensitive material for use in the method of the present invention may further comprise in the silver halide emulsion layer various other additives such as e.g. UV-absorbers, matting agents or spacing agents, lubricants, and plasticizers.

Suitable UV-absorbers are i.a. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

Suitable spacing agents are e.g. finely divided silica particles and polymer beads as described U.S. Pat. No. 4,614,708.

In general, the average particle size of spacing agents is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

A matting agent and/or a lubricant may be added to an emulsion layer and/or a protective layer of the direct-positive photographic light-sensitive material used in the method of the present invention. Suitable matting agents are e.g. water-dispersible vinyl polymers such as poly(methyl methacrylate) having an appropriate particle size of from 0.2 to 6 μm and inorganic compounds e.g. silver halide and strontium barium sulphate. The lubricant is used to improve the slidability of the photographic material. Suitable examples of lubricants are e.g. liquid paraffin, waxes such as esters of higher fatty acids, polyfluorinated hydrocarbons or derivatives thereof, silicones such as polyalkylpolysiloxanes, polyarylpolysiloxanes, polyalkylarylpolysiloxanes and alkyleneoxide addition derivatives thereof.

A variety of photographic supports can be employed for the photographic light-sensitive material used in the method of the present invention. The silver halide emulsion can be coated onto one side or both sides of the support. The support may be transparent or non-transparent. Suitable supports are e.g. a baryta-coated paper, a resin-coated paper e.g. a polyolefin-coated paper, a synthetic paper, a cellulose triacetate film, a polyethylene terephthalate film or another plastic base or glass plate.

In a first step for making a direct-positive image the photographic light-sensitive silver halide material is exposed image-wise. This exposure can either be a high-intensity exposure such as a flash exposure or a normal intensity exposure such as a daylight exposure, a low-intensity exposure such as an exposure by means of a printer, or an exposure of even lower intensity. The light source used for the exposure should match the wavelength sensitivity of the light-sensitive material. Natural light (sunlight), the light emitted by an incandescent lamp, a halogen lamp, a mercury vapour lamp, a fluorescent tube, an electronic flash lamp, or by a metal-burning flash bulb can be used. Gas-, dye-or semiconductor lasers emitting light in the wavelength ranges from ultraviolet to infrared as well as a plasma light source are also suitable light sources for exposing the photographic light-sensitive silver halide material for use in the method of the present invention. A line-shaped light source or a planar light source as well as a microshatter arrangement with a fluorescing area (CRT, etc.), the fluorescence of which is produced by fluorescing substances stimulated by means of electron rays, or even a liquid-crystal display (LCD) or a lanthanum-doped lead-titanium zirconate (PLZT) can be used as well as light sources for exposing the photographic light-sensitive silver halide material for use in the method of the present invention. If necessary, the spectral distribution of the exposure light can be controlled by means of a colour filter.

In a second step for making a direct-positive image the image-wise exposed silver halide material is soaked with, e.g. immersed in, a developing solution. For instance, the image-wise exposed silver halide material is conducted through a tray containing a developing solution.

The developing agents may be incorporated partially or completely into the photographic light-sensitive silver halide material. They may be incorporated during the preparation stage of the material or at a later stage by means of a processing liquid with which the photographic material is wet prior to the development of the direct-positive image. In this way the surface developer can be reduced to a mere alkaline liquid that is substantially free from developing agents. Such an alkaline aqueous liquid, often called "activator" offers the advantage of having a longer activity i.e. of being less rapidly exhausted. The preliminary processing liquid may contain at least a part of the development nucleator and may also contain other ingredients that otherwise would have been incorporated into the developing solution. Wetting of the photographic material by means of a processing liquid comprising development nucleator and/or density-increasing compound may be performed according to any conventional method such as by soaking or by moistening one single side of the material e.g. by means of a lick roller, by spreading a paste e.g. contained in a pod, or by spraying.

The photographic light-sensitive silver halide material used in the method of the present invention may serve different purposes. Application fields, in which direct-positive images can be made in accordance with the present invention, are i.a. graphic arts recording processes, silver salt diffusion transfer reversal processes, microfilm recording processes, duplicating processes for cinematographic black-and-white negatives, infrared laser recording processes, X-ray recording processes, cathode-ray recording processes, fototypesetting processes, etc.

The present invention will be explained in greater detail by reference to the following examples. The present invention should, however, not be construed as being limited thereto. In the Examples the following acronyms and abbreviations are used:

"Dev. Time" stands for "Development Time"
"Dev. Nuc." stands for "Development Nucleator"
"DI" stands for "Density-increasing compound"
"AA" stands for "Alkanolamine"
"HQ" stands for "Hydroquinone"
"AP" stands for "p-N-methyl-aminophenol"
"FPA" stands for "1-formyl-2-phenyl-hydrazine"
"compd." stands for "compound"
"oxalic" stands for "oxalic acid"
"DMPA" stands for "N-dimethyl-propanolamine"
"PG 1000" stands for "polyethylene glycol having a molecular weight of 1000".

EXAMPLE 1

An internal latent image-type direct-positive gelatin silver halide emulsion was prepared by conversion of a silver chloride emulsion in the presence of water-soluble bromide and iodide to form grains having a core of silver chloride (4 mol %) and a shell of silverbromoiodide (95/1 mol %). The average grain diameter was 0.4 μm.

A dispersion of the development nucleator 1-formyl-2-phenyl-hydrazine was made by passing a mixture of 300 g of a 20% aqueous solution of gelatin and 60 g of the development nucleator for 120 min through a sand mill.

The dispersion was added to the silver halide emulsion in a concentration of 200 mg per 5 g of silver halide.

The resulting emulsion was coated on a cellulose triacetate support at a ratio of 6.5 g of silver halide per m2 and dried.

Several samples of the light-sensitive material obtained were exposed identically for $10^{-5}$ s to white light emitted by a U460 flashlight sold by EG&G ING, 45 William street, Wellesley, Mass. 02181, USA and then developed with a hydroquinone-type developing solution (bath) at a temperature of 35° C., said developing solution comprising the following ingredients:

| | |
|---|---|
| demineralized water | 700 ml |
| hydroquinone | (amount see Table 1) |
| p-N-methyl-aminophenol | (amount see Table 1) |
| density-increasing compound | (amount see Table 1) |
| alkanolamine | (amount see Table 1) |
| sodium sulphite | 110 g |
| sodium hydroxide | 18 g |
| sodium carbonate | 40 g |

-continued

| | |
|---|---|
| potassium bromide | 3 g |
| demineralized water to make | 1 l |

The Dmax and Dmin values were measured and are listed in Table 1. The development time, the content of hydroquinone, the content of the secondary developing agent p-N-methyl-aminophenol, the pH-value of the developing solution, the development nucleator, the density-increasing compound and the amount added thereof, the alkanolamine and the amount added thereof are specified in Table 1.

TABLE 1

| Dev. | Amount | | pH of | Dev. | DI | | AA | | | |
|---|---|---|---|---|---|---|---|---|---|---|
| Time | HQ | AP | bath | Nuc. | compd. | amount | compd. | amount | Dmax | Dmin |
| 60 s | 40 g | 15 g | 11.25 | FPA | — | — | DMPA | 40 g | 2.45 | 0.10 |
| 60 s | 40 g | 15 g | 11.25 | FPA | oxalic | 7.5 g | DMPA | 40 g | 2.55 | 0.11 |
| 60 s | 24 g | 30 g | 11.25 | FPA | — | — | DMPA | 40 g | 0.86 | 0.10 |
| 45 s | 24 g | 60 g | 11.25 | FPA | oxalic | 5.0 g | DMPA | 40 g | 2.01 | 0.12 |
| 60 s | 24 g | 30 g | 11.25 | FPA | oxalic | 5.0 g | DMPA | 40 g | 2.42 | 0.18 |

It appears from the results listed in Table 1 that the addition of oxalic acid to a hydroquinone-type developing solution having a pH lower than 12 and comprising as much as 40 g of hydroquinone leads to a slight increase of Dmax. When, however, the content of hydroquinone is less than 25 g in accordance with the present invention, the addition of oxalic acid leads to a substantial gain in Dmax.

EXAMPLE 2

A first series of samples of light-sensitive material comprising a dispersion of 1-formyl-2-phenyl-hydrazine development nucleator were made and exposed as described in Example 1.

A second series of samples of light-sensitive material, differing from the first series only in that equivalent amounts of the development nucleator having structural formula X were used instead of 1-formyl-2-phenyl-hydrazine, were made and exposed as described in Example 1.

All samples were developed for 45 s at 35° C. with a hydroquinone-type developing solution having a pH-value of 11.5 and comprising the following ingredients:

| | |
|---|---|
| demineralized water | 700 ml |
| hydroquinone | 24 g |
| p-N-methyl-aminophenol | 30 g |
| density-increasing compound | (specified in Table 1) |
| DMPA | 40 ml |
| sodium sulphite | 50 g |
| sodium hydroxide | 18 g |
| sodium carbonate | 40 g |
| sodium bromide | 3 g |
| demineralized water to make | 1 l |

The Dmax and Dmin values were measured and are listed in Table 2. The development nucleator and the density-increasing compound and the amount added thereof are specified in Table 2.

TABLE 2

| Density-increasing | | 1-formyl-2-phenyl-hydrazine | | Dev. Nuc. X | |
|---|---|---|---|---|---|
| compound | amount | Dmax | Dmin | Dmax | Dmin |
| none | | 1.84 | 0.14 | — | — |

TABLE 2-continued

| Density-increasing | | 1-formyl-2-phenyl-hydrazine | | Dev. Nuc. X | |
|---|---|---|---|---|---|
| compound | amount | Dmax | Dmin | Dmax | Dmin |
| formic acid | 10 g | 1.94 | 0.17 | 1.45 | 0.17 |
| PG 1000 | 10 g | 1.94 | 0.15 | 1.59 | 0.16 |
| oxalic acid | 5 g | 2.04 | 0.16 | 1.64 | 0.18 |
| glyoxylic acid | 5 g | 1.96 | 0.12 | 1.55 | 0.13 |
| { oxalic acid + | 5 g | 2.08 | 0.14 | 1.62 | 0.18 |
| glyoxylic acid } | 10 g | | | | |

It appears from the results listed in Table 2 that the addition of the density-increasing compounds formic acid, PG 1000, oxalic acid, glyoxylic acid, or mixture of glyoxylic acid and oxalic acid to a hydroquinone-type developing solution comprising but 24 g of hydroquinone and having a pH of but 11.5 leads to enhanced Dmax values.

We claim:

1. Method for the production of black and white direct-positive images comprising:

image-wise exposing a photographic light-sensitive silver halide material comprising a support and at least one internal latent image-type silver halide emulsion layer, developing said exposed silver halide material in the presence of at least one development nucleator and density-increasing amounts of oxalic acid in an amount from 1–10 g/l, with a hydroquinone-type developing solution having a pH between 10.0 and 12.0 and comprising:

from 15 to less than 25 g per liter of a hydroquinone and 5 to 100 g per liter of at least one alkanolamine.

2. A method according to claim 1, wherein said development nucleator is a phenyl hydrazide.

3. A method according to claim 1, wherein said development nucleator is a hydrazine carrying a pyrazolidin-3-one-1-yl-phenyl group or a substituted pyrazolidin-3-one-1-yl-phenyl group.

4. A method according to claim 1, wherein said development nucleator has been added in dispersed form to the hydrophilic colloid composition that will form said emulsion layer or a hydrophilic colloid layer in water-permeable relationship therewith.

5. A method according to claim 1, wherein said development nucleator has been incorporated into the hydrophilic colloid composition that will form said silver halide emulsion layer or a hydrophilic colloid layer in water-permeable relationship therewith by mixing said development nucleator and an aqueous hydrophilic colloid solution, passing the resulting mixture through a homogenizing apparatus, adding the dispersion obtained to said hydrophilic colloid composition, and coating said hydrophilic colloid composition on a support.

6. A method according to claim 1, wherein the development nucleator is present in said silver halide emulsion layer in an amount of from about 0.6 to about 9 g per mol of silver halide.

7. A method according to claim 1, wherein the density-increasing compound is oxalic acid in combination with glyoxylic acid.

8. A method according to claim 1, wherein said density-increasing compound when incorporated into the photographic material is present therein in amounts of from 40 to 300 mg/m2.

9. A method according to claim 1, wherein said at least one alkanolamine is present in the developing solution in amounts of from 10 to 60 g/l.

10. A method according to claim 9, wherein the hydroquinone-type developing solution comprises 24 g per liter of hydroquinone.

* * * * *